United States Patent [19]

Tobey

[11] Patent Number: 5,026,407

[45] Date of Patent: Jun. 25, 1991

[54] EXTERNAL SEPARATOR FOR VACUUM WASTE SYSTEM

[75] Inventor: Jon B. Tobey, Kirkland, Wash.

[73] Assignee: The Boeing Company, Seattle, Wash.

[21] Appl. No.: 578,748

[22] Filed: Sep. 6, 1990

[51] Int. Cl.[5] ..... B01D 19/00

[52] U.S. Cl. ..... 55/185; 55/188; 55/190; 55/337; 55/385.4; 55/508

[58] Field of Search ..... 55/185-187, 55/189, 190, 385.4, 337, 421, 508, 525, 528, 183, 188

[56] References Cited

U.S. PATENT DOCUMENTS

| | | | |
|---|---|---|---|
| 2,256,524 | 9/1941 | McKelvey | 183/2.7 |
| 2,790,554 | 4/1957 | Work | 210/294 |
| 3,127,255 | 3/1964 | Winslow | 55/421 X |
| 3,499,270 | 3/1970 | Paugh | 55/337 |
| 3,922,730 | 12/1975 | Kemper | 4/10 |
| 3,995,328 | 12/1976 | Carolan et al. | 4/10 |
| 4,063,315 | 12/1977 | Carolan et al. | 4/10 |
| 4,092,137 | 5/1978 | Howe et al. | 55/337 |
| 4,385,912 | 5/1983 | Parrick et al. | 55/329 |
| 4,534,861 | 8/1985 | Wedemeyer et al. | 55/185 X |
| 4,547,917 | 10/1985 | Akesson | 4/300 |
| 4,687,495 | 8/1987 | Maddox | 55/189 X |
| 4,865,631 | 9/1989 | Stroby et al. | 55/163 |
| 4,887,936 | 12/1989 | Christianson et al. | 55/337 X |

*Primary Examiner*—Charles Hart

*Attorney, Agent, or Firm*—Bruce A. Kaser

[57] ABSTRACT

The apparatus disclosed here is a separator that is adapted for use in connection with aircraft waste tank systems. The apparatus separates air from entrained solid and liquid waste. It has a canister body that is mounted to the top of a waste tank, and a bowl enclosure received within the canister body, the latter providing a filtering chamber. The canister body's inner walls define a cylindrical space around the bowl enclosure. Projecting a certain distance upwardly into such space is an intermediate wall that divides it into outer and inner passageways. A plurality of inlets positioned around the base of the canister body lead into the outer passageway. After entering the inlets, air with entrained waste first travels upwardly through the outer passageway, bends around the upper end of the intermediate wall, and travels downwardly through the inner passageway into an area that is immediately below the bowl enclosure. The bowl enclosure has a bottom inlet that permits the air to thereafter pass upwardly through its filtering chamber.

13 Claims, 2 Drawing Sheets

EXTERNAL SEPARATOR FOR VACUUM WASTE SYSTEM

TECHNICAL FIELD

This invention generally relates to methods and devices for separating entrained solid matter and moisture from an airflow, and more particularly, to air separators that are adapted for use in connection with aircraft vacuum toilet systems.

BACKGROUND INFORMATION

Anyone who has ever made a relatively long flight aboard a commercial passenger jet is probably familiar with their toilets. Flushing these devices results in toilet fluids and solid wastes being drawn from a toilet bowl down a waste line. Unlike conventional toilets, where waste exits the toilet bowl via a circular water flow that carries the waste through a bottom outlet, the toilets in the most recent passenger jet models are vacuum toilets that rely upon suction for removing waste. This creates the familiar sucking sound that accompanies flushing this particular toilet. Older jets have recirculating systems where solid waste is essentially strained from toilet liquids, and the liquids are reused for later flushings.

The present invention relates to the more recent vacuum toilet systems. A common attribute of such systems is that a flushing airflow is created by venting toilets externally of the aircraft. This is accomplished by opening a valve, which creates an airflow path from a given toilet bowl to the outside or ambient atmosphere via a waste line and tank system. The pressure differential between the toilet cabin and the ambient is what actually generates the airflow At certain low elevations, where the pressure differential is not great (below 16,000 feet, for example), a vacuum blower is employed to assist or augment the natural pressure differential between inside and outside the aircraft.

Of course, the solid and liquid waste in the toilet is not simply dumped outside the aircraft. Instead, it is separated from the airflow, and deposited in a waste tank prior to venting the air overboard.

Typically, the airflow and entrained waste travel from the toilet to the waste tank via conventional pipes or lines. The conventional waste tank has one or more waste inlets configured to direct the flow circumferentially in a clockwise direction around the tank's interior, but at a level that is above and parallel to the level of waste already in the tank. As a result, a combination of centrifugal forces and gravity cause separation of much of the entrained matter from the airflow, and it simply drops downwardly into the tank. Some entrained matter remains with the airflow and is removed via a separator as it exits the tank. This device is normally positioned inside the top portion of the tank.

To function effectively, the conventional separator is dependent upon the above-described clockwise or circular airflow generated when it enters the tank. The conventional separator has inlets which face away from such direction, requiring the flow to first turn nearly 180° in order to gain entry into the separator. This creates a sudden momentum change that helps separate heavier particles of solid waste and droplets of moisture in the flow prior to further processing inside the separator. A good example of this motion is illustrated in U.S. Pat. No. 4,385,912, issued to Parrick et al. on May 31, 1983. Such reference is illustrative of the operation of all separators presently used by The Boeing Company in its aircraft toilet systems.

The waste tank system described above has sensors for detecting the level of waste inside the tank. These sensors have faces that are positioned at a certain vertical height along the tank's inner wall, and provide an electrical signal indicating a full tank in response to contact with the waste as its level rises. In the full tank condition, the level sensors remove power from all toilets connected to that tank.

The above-described tank inlet arrangement, which creates a circular flow motion inside the tank, also creates a problem in that it tends to coat the waste level sensor faces with solid and liquid waste. This has been known to cause the sensors to emit signals falsely indicating a full tank, resulting in unnecessary shutdown of the toilet. This naturally results in a serious inconvenience for the passengers.

The typical waste tank system also has one or more rinse nozzles that protrude into the tank. These are connectable to an external source of clean water for periodically rinsing and/or cleaning the tank during aircraft maintenance intervals. They also tend to be coated by incoming waste from tank inlets which can clog them.

In addition to the coating and clogging problems just described, another problem associated with the conventional waste tank system is that its separator typically projects downwardly a significant distance into the tank. This consequently blocks or shadows portions of the tank's inner walls from the spray of the rinse nozzles, and has made it difficult to completely clean the tank, including coated sensor faces. It also decreases the maximum storable waste volume inside the tank since the separator itself takes up some of the space at the tank's top.

As will become apparent, the separator disclosed here provides an improved design for use in aircraft toilet systems that overcomes the above problems That is to say, a separator in accordance with the invention does not require creation of a circular airflow in one particular direction inside the tank, like the system described above. This enables more flexibility in arranging tank inlets in order to avoid coating sensors with waste matter. Further, a separator in accordance with the invention protrudes only slightly into the tank. This creates more space for waste, and eliminates the rinse blocking problem described above.

SUMMARY OF THE INVENTION

A separator in accordance with the invention has a bowl enclosure received within a canister body, the latter being mounted to the top of a waste tank. The bowl enclosure's walls define a filtering chamber in which an air-filtering material is received. The outer sidewall of the bowl enclosure is surrounded by and inwardly spaced from an inner sidewall of the canister body. This structural arrangement creates a space that also completely surrounds the bowl enclosure. Such space is closed at its upper end by a wall, or an air-turning wall, which extends between the outer sidewall of the bowl enclosure and the inner sidewall of the canister body.

Extending upwardly into the surrounding space is an intermediate wall enclosure that also surrounds the bowl enclosure. The latter wall's inward or upper end is spaced a certain distance below the air-turning wall that closes the space's upper end. This structural configuration enables the intermediate wall to define an outer passageway between it and the canister body's inner sidewall, and an inner passageway, between it and the bowl enclosure's outer sidewall. These two passageways are interconnected by an air-turning region, which is the gap between the upper end of the intermediate wall and the air-turning wall just mentioned.

A plurality of air inlets are distributed peripherally around a base portion of the canister body. This portion is preferably the only part of the separator that projects downwardly into the waste tank, and enables a toilet airflow with entrained matter to enter the inlets The inlets function to separate the majority of solid waste particles from the airflow, and mainly allow only entrained moisture into the separator.

The inlets encourage separation as the flow enters the separator regardless of clockwise or counter clockwise flow direction in the tank. Each inlet is constructed of a pair of outwardly projecting wall sections that converge toward each other. A space between the ends of these sections defines the inlet opening. The angles of such sections are optimally selected so that, regardless of flow direction, a certain amount of flow bending, and hence, air separation, occurs as the flow enters the separator.

The outer passageway, between the canister and intermediate wall, leads upwardly from the inlets to the air-turning region, and the inner passageway on the other side of the intermediate wall leads downwardly from such region into the lower portion of the separator. This creates a 180° flow bend inside the separator which tends to further separate air from entrained matter after passing into the separator.

The bowl enclosure has a bottom inlet and a top outlet. The bottom inlet is in airflow communication with the separator's inner passageway, so that the airflow from such passageway enters and passes through the filtering material in the bowl's chamber Such chamber has a relatively wide crosssection which slows the speed of the flow by expansion, better enabling the filtering material to remove any last remnants of entrained matter via impingement. After filtering, the airflow exits outwardly through the top outlet and is vented to the ambient environment.

The invention as summarized above will become more fully understood upon consideration of the following detailed description which is to be read in conjunction with the drawings.

BRIEF DESCRIPTION OF THE DRAWINGS

In the drawings, like reference numbers and letters refer to like parts throughout the various views, unless indicated otherwise, and wherein.

BEST MODE FOR CARRYING OUT THE INVENTION

Figure 1:
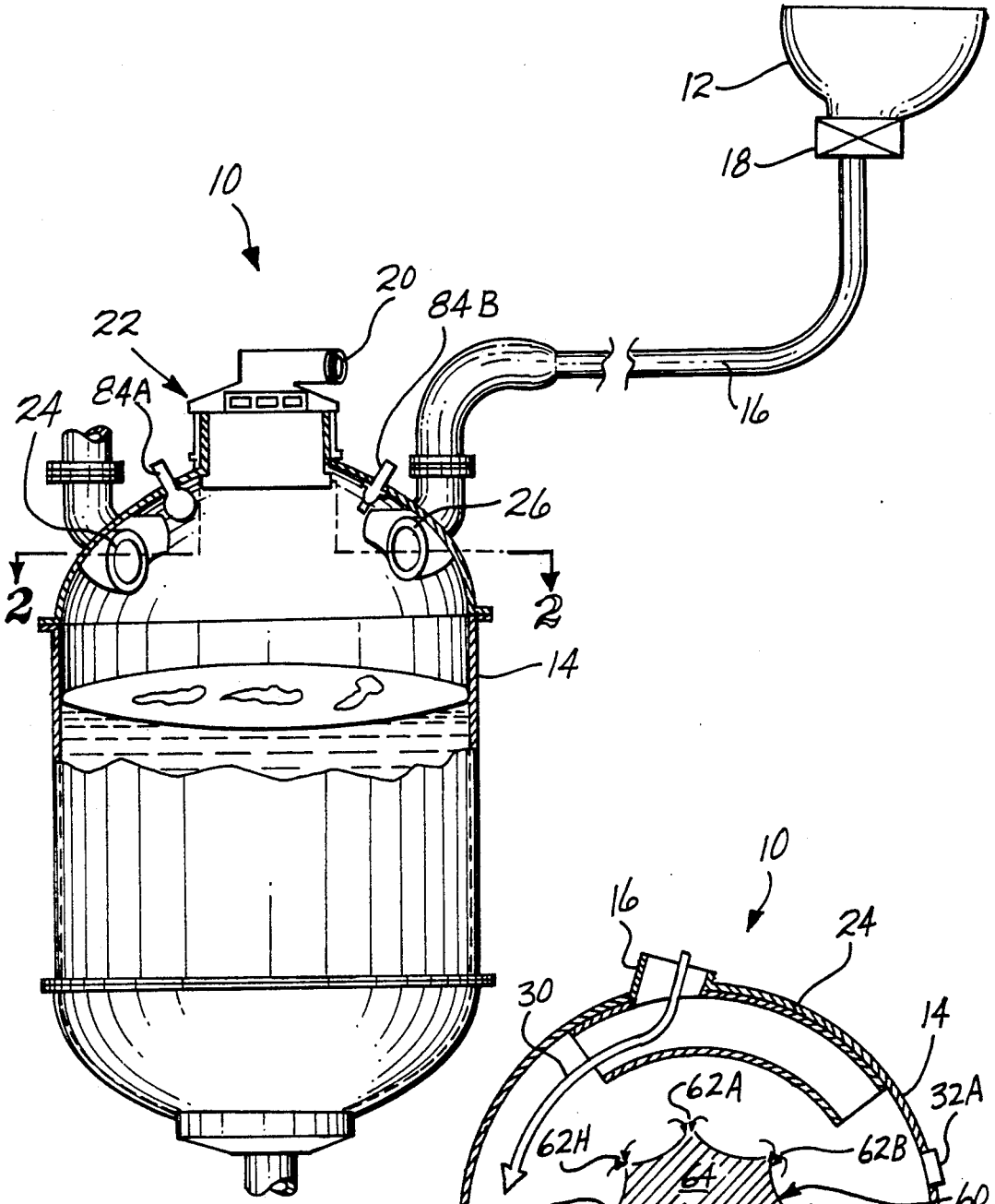
FIG. 1 is a side cross-sectional view of a waste tank, and shows a separator in accordance with the invention mounted to the top of the tank, and also shows waste lines interconnecting the tank with a toilet bowl.

Referring now to the drawings, and first to FIG. 1, shown generally at 10 is vacuum lavatory waste system that utilizes a separator in accordance with the invention. The system 10 includes a toilet 12 connected to a waste storage tank 14 by a waste line 16. Of course, and as the skilled person would realize, in actual practice a plurality of toilets 12 would be connected to the tank !4 via numerous waste lines 16.

The toilet 12 is flushed by opening a valve 18 at the bottom of the toilet's bowl which creates an airflow passageway from the toilet 12 to an ambient vent 20. Solid and liquid waste inside the toilet is drawn through waste line 16 into the tank 14 by the pressure differential between the aircraft cabin and the ambient pressure outside the aircraft. As mentioned above, the system 10 may be provided with a vacuum blower that assists the creation of an airflow at lower elevations where the difference between cabin and ambient pressure is not great. This is not shown in the drawings, however, as it is not particularly germane to the invention disclosed and claimed here.

A separator device in accordance with the invention, indicated generally at 22, is shown mounted to the top of tank 14. The airflow from inside the aircraft cabin, with entrained matter that was deposited in toilet 12, enters the tank 14 via waste inlet tees 24, 26. As discussed above, in the past, such tees were arranged to impart a clockwise circular direction to the flow from both tees. This arrangement enhanced separation of the entrained matter with the air prior to entry into a separator, but also caused waste impingement on level sensors and rinse nozzles. Here, inlet tees 24, 26 may be arranged in the manner shown in FIG. 2, where the flow may be directed either clockwise as shown at 28, or counter clockwise as shown at 30. This allows the flow be directed away from tank waste level sensors, which are schematically indicated at **32*a*, 32*b*, and from the tank's rinse nozzle 84*b***.

Figure 3:
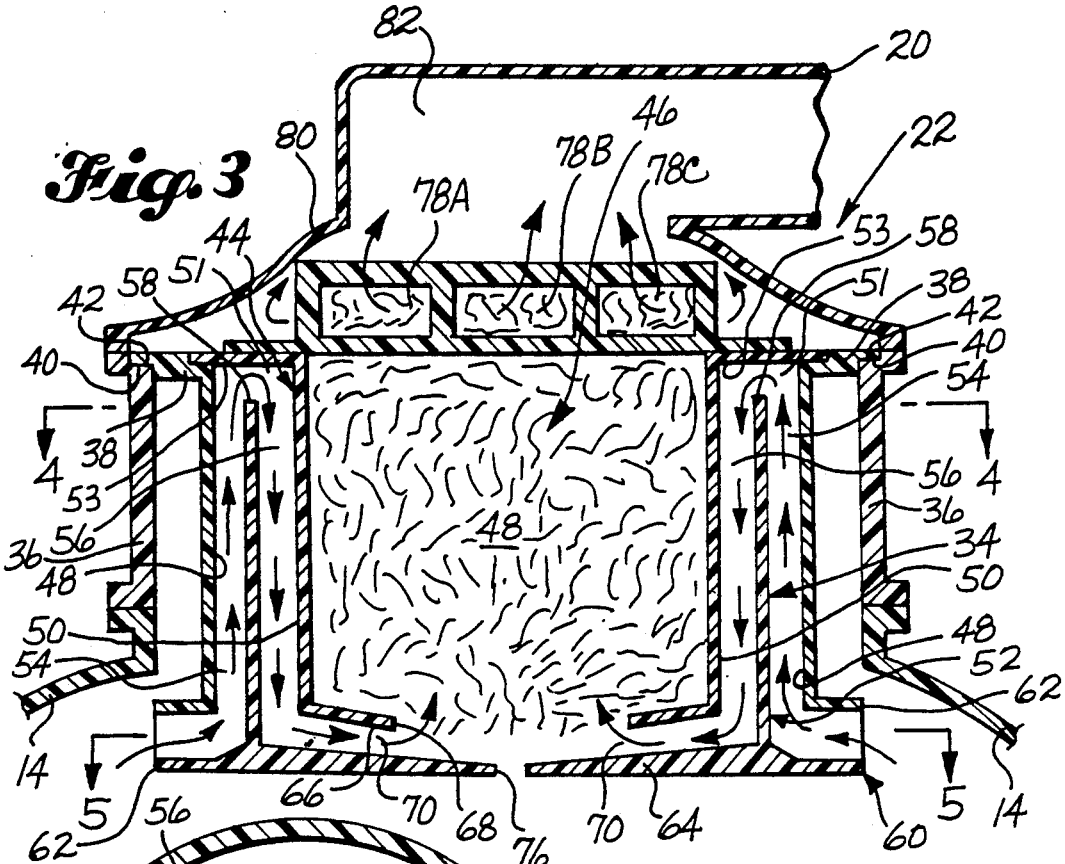
FIG. 3 is an enlarged side cross-sectional view of the separator shown in FIG. 1.

Referring now to FIG. 3, the separator 22 has a canister body 34 connected to a cylindrical neck portion 36 of waste tank 14. By way of illustrative example, such connection may be accomplished by an annular flange 38 that has an underlying outer grooved edge 40 resting upon an upwardly-facing annular groove 42 in the top of tank neck 36.

Received within the canister body 34 is a bowl enclosure 44. The walls of such enclosure 44 are shaped to define a filtering chamber or region, indicated generally at 46. An air filtering material 48 is received in such chamber 46. Preferably, the filtering material 48 is a polypropylene mesh that completely fills the chamber 46.

As is apparent from FIG. 3, the inner side wall 48 of canister body 34 is spaced outwardly from and completely surrounds the bowl enclosure's outer side wall 50. This creates a cylindrical space 51 that also completely surrounds outer side wall 50. The upper part of such space 51 is closed by an annular air-turning wall 53 that extends between outer and inner walls 50, 48.

A third or intermediate wall enclosure 52 extends upwardly into space 51 between canister and enclosure walls 48, 50, and terminates in such space. It divides space 51 into outer and inner passageways 54, 56, and its upper or inner end 58 is spaced from and defines a gap below air-turning wall 53. This creates an air-turning region for communicating an airflow with entrained matter between outer and inner passageways 54, 56, and for separating the air from the entrained matter.

The separator 22 has a base portion 60 (see FIG. 5) that projects downwardly into tank 14. Such portion 60 has a plurality of air inlets 62*a–h* circumferentially or peripherally distributed around its circumference. Preferably, each inlet 62*a–h* is equidistant from adjacent inlets.

A bottom plate 64 of base portion 60 defines the shape of the bottom of the separator 22 and its air inlets 62*a–h*. Such plate 64 is directly connected to intermediate wall 52. The inner bowl enclosure 44 described above has a bottom enclosure wall 66 that functions to retain the filtering material 48 in filtering chamber 46. Such wall 66 has a bottom inlet opening, indicated at 68, that is preferably circular in shape. Bottom plate 64 and bottom enclosure wall 66 cooperatively define a downwardly-sloping lower pathway 70 for communicating airflow with any remaining entrained matter from inner passageway 56 into filtering chamber 46.

Figure 4:
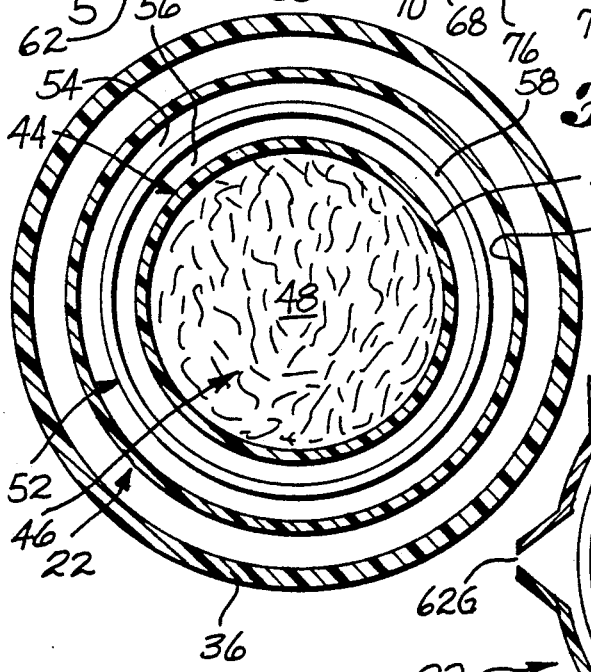
FIG. 4 is a transverse cross-sectional view of the separator shown in FIG. 3, and is taken looking downwardly along line 4—4 in FIG. 3.

As is shown in FIG. 4, the wall 50 of bowl enclosure 44, the intermediate wall enclosure 52, and the wall 48 of the canister body 34 are all cylindrical in shape, and all are concentrically arranged with respect to each other. The outer and inner airflow passageways 54, 56 are therefore also cylindrically concentric, and annular in cross-section.

Figure 2:
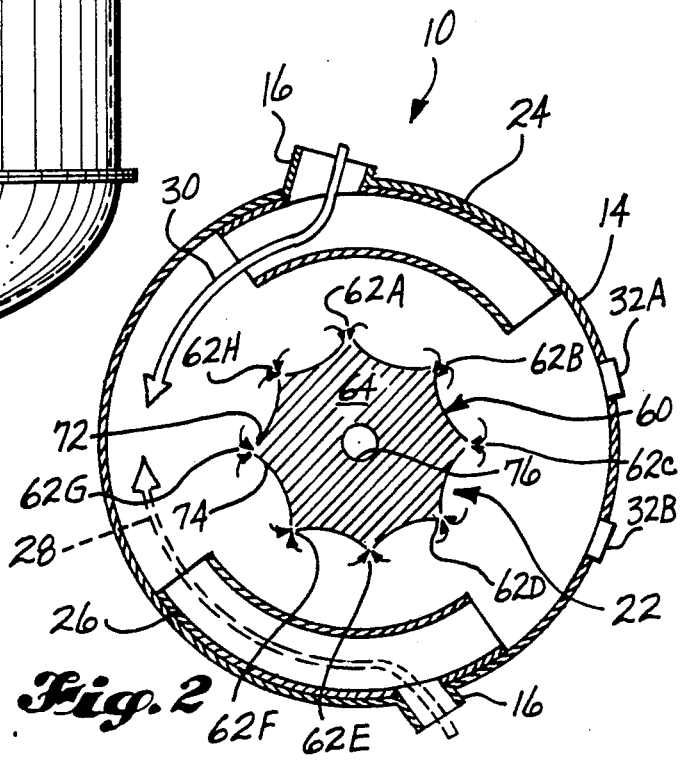
FIG. 2 is a transverse cross-sectional view of the tank as shown in FIG. 1, and is taken along line 2—2 in FIG. 1, looking downwardly inside the tank with the bottom of the separator shown in cross-section.
Figure 5:
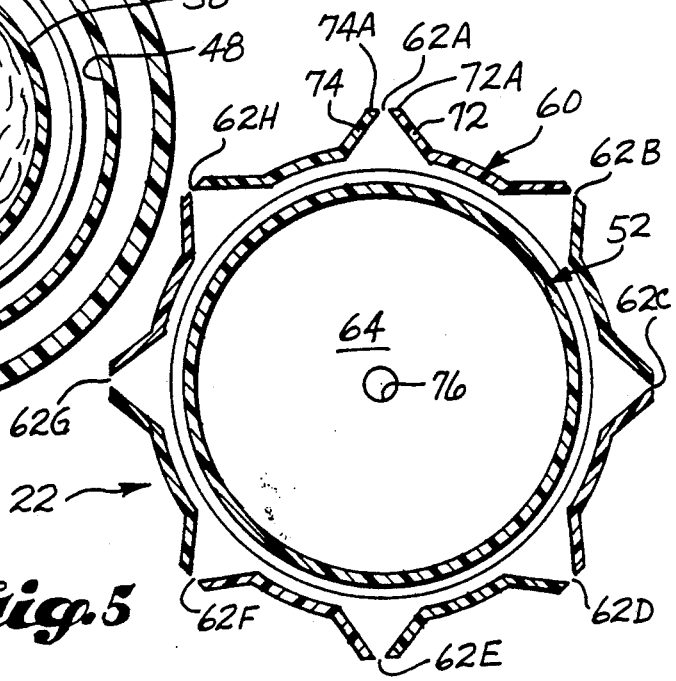
FIG. 5 is a transverse cross-sectional view of the separator shown in FIG. 3, and is taken looking downwardly along line 5—5 in FIG. 3.

Any airflow with entrained matter that enters tank 14 thereafter enters base portion inlets 62*a–h* from one direction or another (in either a clockwise or counter clockwise direction as shown in FIG. 2), depending on the flow direction entering the tank. As shown in FIG. 5, each inlet 62*a–h* preferably has a pair of converging wall sections 72, 74 which project outwardly from base portion 60. The ends or outer edges 72*a*, 74*a* of such sections are spaced from each other to define each respective inlet. This configuration requires a certain bending of the flow as it enters the separator 22, the consequent change in momentum having a first stage separating effect similar to the inlets disclosed in U S. Pat. No. 4,385,912. Most of the solids that are entrained are separated from the flow by inlets 62*a–h*. The remaining entrained matter is primarily moisture Directing attention again to FIG. 3, upon entering inlets 62, the flow travels upwardly through outer passageway 54 and makes a 180° turn around the upper end 58 of the intermediate wall enclosure 52. This turn causes further flow separation by decreasing the momentum of entrained matter, and slowing it down, without a significant pressure drop in the airflow itself. Any entrained matter that is separated simply drops or drains downwardly through outer or inner passageways 54, 56.

After passing through the air-turning region, the flow then travels downwardly through inner passageway 56 and into lower passageway 70 below bowl enclosure 44. Any entrained matter which drops out of the flow at this point may exit the separator through an opening 76 in separator bottom plate 64. Such opening 76 is preferably positioned directly below chamber bottom inlet 68. In preferred form, passageway 70 is sloped downwardly toward opening 76 in order to facilitate the downward flow of separated material by the force of gravity.

The flow is lastly filtered through chamber 46 and exits the chamber via outlets 78*a*, 78*b*, 78*c*. A cap portion 80 of the separator defines a space 82 over the canister body 34, and the components enclosed thereby. The outlets 78*a–c* project upwardly into such space 82, and the air from the outlets is vented to the aircraft exterior as shown at 20.

It is believed that the separator 22 disclosed herein is unique over the prior art because of the unique construction of its air inlets 62*a–h*, and the flow separation path defined by outer and inner passageways 54, 56. The inlets 62*a–h* cause an initial flow separation regardless of the direction of flow in tank 14. A second stage of separation occurs in the airturning region between the upper end 58 of intermediate wall enclosure 52 and air-turning wall 53. The combination of these two separation stages allow the separator 22 to be more effective at slowing solid and fluid momentum, without significant increases in air pressure drops across the separator, at least when compared to previous separator designs. This represents an increased efficiency that allows the separator 22 to be constructed more compactly than other separators.

Further, the unique construction of the separator 22 enables it to be mounted to the top of the tank 14 with only the base portion projecting downwardly into and taking up part of the tank's volume. This provides more usable space within the tank, and eliminates separator shadowing the tank's rinse nozzle 84*b* (see FIG. 1).

Indicated at 84*a* is a maintenance tool that is preferably connected to a source of high pressure water. Use of such tool 84*a* is also made possible by the above-described mounting arrangement of the separator 22 to the tank 14.

Having presented the above description, it is to be appreciated that the separator 22 disclosed above may subsequently change in design to a certain extent without departing from what is considered to be the spirit and scope of the invention. The preceding description is not to be taken in a limiting sense, but is only to be taken as the best way to implement or practice the invention as it is presently known. Further improvements to the separator 22 may still be made. For this reason, it is the following patent claims that define the scope of the invention, and it is to be understood that the metes and bounds defined by such claims are to be determined in accordance with the well-established doctrines of patent claim interpretation.

What is claimed is:

1. An apparatus for separating entrained matter from an airflow, comprising:

an inner wall defining a filtering region having an inlet and an outlet, and an air-filtering material received in said region;

an outer wall surrounding said inner wall in spaced relationship therefrom;

an intermediate wall also surrounding said inner wall and extending inwardly into and terminating in the space between said inner and outer walls, said intermediate wall defining an outer passageway between said intermediate wall and said outer wall, and an inner passageway between said intermediate wall and said inner wall, and an air-turning region adjacent said intermediate wall's inwardly-extending end, said region permitting an airflow in said outer passageway to turn around said inwardly-extending end from said outer to inner passageways; and a plurality of air inlets leading into said outer passageway, wherein said outer passageway leads upwardly from said inlets, and said inner passageway leads downwardly from said air-turning region, said inner passageway being in airflow communication with said filtering region, to deliver said airflow into said region and through said filtering material therein before said airflow exits through said region's top outlet.

2. The apparatus of claim 1, wherein said inner, outer and intermediate walls are all generally cylindrical in shape and concentrically arranged with respect to each other.

3. The apparatus of claim 2, wherein said plurality of air inlets are circumferentially spaced around a base portion that is positioned immediately below said outer wall.

4. The apparatus of claim 3, wherein each inlet is defined by a pair of converging wall sections of said base portion, each wall section having an outer end, said ends being spaced apart from each other to define an inlet airspace therebetween.

5. The apparatus of claim 3, including a bottom enclosure wall connected to said inner wall for defining a lower boundary of said filtering region, said bottom enclosure wall having a central opening which defines said inlet into said filtering region, and wherein said base portion includes a bottom plate, said bottom plate and said bottom enclosure wall cooperatively defining an airflow pathway from said inner passageway to said filtering region, said bottom plate having an opening therethrough positioned directly below said filtering region inlet, for permitting entrained matter to exit said apparatus via the force of gravity.

6. The apparatus of claim 5, wherein said bottom enclosure wall and said bottom plate cooperatively define an airflow pathway that slopes downwardly toward said opening in said bottom plate.

7. An apparatus for separating entrained matter from an airflow, comprising:

a canister body having a base portion with a plurality of air inlets peripherally spaced around said base portion;

a bowl enclosure received within said canister body, and shaped to define a filtering chamber, said bowl enclosure containing an air-filtering material, and having an inlet and outlet for respectively delivering air to and from said filtering material, and wherein said bowl enclosure has an outer sidewall surrounded by and spaced from an inner sidewall of said canister body, to define a space that surrounds said bowl enclosure's outer sidewall, said space being closed at one end by an air-turning wall that extends between said outer and inner sidewalls;

and an intermediate wall enclosure surrounding said bowl enclosure and positioned inbetween said canister body's inner sidewall and said bowl enclosure's outer sidewall, and dividing said space into outer and inner airflow passageways, an upper end of said intermediate wall enclosure being spaced from said air-turning wall so as to provide an airflow path along such wall between said outer and inner passageways, said outer passageway being in airflow communication with said peripherally spaced air inlets, to receive via such inlets an airflow with entrained matter, said outer passageway leading upwardly from such inlets to carry said airflow up and around said upper end of said intermediate wall enclosure, and downwardly through said inner passageway, said inner passageway being in airflow communication with said filtering chamber inlet, to deliver said airflow into said chamber and through said filtering material therein before it exits through said chamber's outlet.

8. The apparatus of claim 7, wherein said outer side wall of said bowl enclosure, and said inner side wall of said canister body, and said intermediate wall enclosure are all generally cylindrical in shape and concentrically arranged with respect to each other.

9. The apparatus of claim 7, wherein each one of said plurality of air inlets is defined by a pair of outwardly-projecting converging wall sections of said base portion, each wall section having an outer end, said outer ends being spaced apart from each other to define an air inlet therebetween.

10. The apparatus of claim 8, wherein said base portion includes a bottom plate, and a lower end of said intermediate wall enclosure is connected to said bottom plate, and wherein said bowl enclosure includes a bottom enclosure wall defining a lower boundary of said filtering chamber, said bottom enclosure wall having a central opening which defines said inlet into said filtering chamber, and wherein said bottom plate of said base portion and said bottom enclosure wall of said bowl enclosure cooperatively define an airflow pathway from said inner passageway to said filtering chamber, said bottom plate having an opening therethrough positioned directly below said filtering chamber inlet, for permitting entrained matter to exit said apparatus via the force of gravity.

11. The apparatus of claim 10, wherein said bottom enclosure wall and said bottom plate cooperatively define an airflow pathway that slopes downwardly toward said opening in said bottom plate.

12. The apparatus of claim 8, including a cap portion connected to said canister body, said cap portion defining a space over said bowl enclosure, said bowl enclosure having an outlet portion projecting upwardly into such space, for communicating a filtered airflow therein, said cap having a vent outlet.

13. The apparatus of claim 8, wherein said base portion protrudes downwardly into a space defined by the walls of a waste tank.

* * * * *